US005544638A

United States Patent [19]

Yuda

[11] Patent Number: 5,544,638

[45] Date of Patent: Aug. 13, 1996

[54] APPARATUS FOR DISPOSING OF FUEL VAPOR

[75] Inventor: Shuji Yuda, Susono, Japan

[73] Assignee: Toyota Jidosha Kabushiki Kaisha, Toyota, Japan

[21] Appl. No.: 413,576

[22] Filed: Mar. 30, 1995

[30] Foreign Application Priority Data

Apr. 22, 1994 [JP] Japan ..... 6-084745

[51] Int. Cl.[6] ..... F02D 41/14; F02M 25/08

[52] U.S. Cl. ..... 123/674

[58] Field of Search ..... 123/674, 675, 123/698, 520

[56] References Cited

U.S. PATENT DOCUMENTS

| | | | |
|---|---|---|---|
| 5,048,492 | 9/1991 | Davenport et al. | 123/674 |
| 5,090,388 | 2/1992 | Hamburg et al. | 128/674 |
| 5,245,978 | 9/1993 | Orzel | 123/674 |
| 5,363,830 | 11/1994 | Morikawa | 123/674 |
| 5,400,761 | 3/1995 | Fukasawa et al. | 123/674 |
| 5,406,927 | 4/1995 | Kato et al. | 123/674 |
| 5,425,349 | 6/1995 | Nagaishi et al. | 123/674 |

FOREIGN PATENT DOCUMENTS 62-205262 9/1987 Japan .

*Primary Examiner*—Willis R. Wolfe
*Attorney, Agent, or Firm*—Kenyon & Kenyon

[57] ABSTRACT

Fuel-vapor evaporating from a fuel tank 13 is led through a vapor pipe 133 and absorbed in a charcoal canister 14. When a large amount of fuel is trapped in the charcoal canister, the learning of the basic air-fuel ratio correction factor executed in the control system 15 is interrupted in order to avoid faulty learning and the purging of fuel from the charcoal canister to the engine is continued in order to ensure sufficient fuel-purging. Only when a small amount of fuel is trapped in the charcoal canister, and the engine is driving in the region where the basic air-fuel ratio correction factor has not been learned, its learning is executed.

2 Claims, 9 Drawing Sheets

APPARATUS FOR DISPOSING OF FUEL VAPOR

BACKGROUND OF THE INVENTION

1. Field of the Invention

The present invention relates to an apparatus for disposing of fuel-vapor, especially to an apparatus for disposing of fuel-vapor which can avoid mistaken learning of basic air-fuel ratio correction factors when purging of fuel-vapor evaporating from a charcoal canister is initiated.

2. Description of the Related Art

Fuel-vapor evaporating from a fuel tank is absorbed in a charcoal canister, and is properly purged into an inlet pipe, as fuel, in order to improve fuel consumption and to avoid air pollution.

However, because the fuel-vapor purged from the charcoal canister disturbs the air-fuel ratio control of an engine, a purge procedure which does not disturb the air-fuel ratio control must be applied.

Especially, it is very important that the air-fuel ratio control system having a learning function for a basic air-fuel ratio correction factors, in order to compensate for deterioration with age of an air-flow meter or fuel-injection valves associated with the engine, does not inhibit faulty learning of basic air-fuel ratio correction factors when purging of fuel-vapor evaporating from a charcoal canister is initiated.

Because a basic air-fuel ratio correction factor is generally learned for every driving region which is determined in accordance with the driving condition of the engine, a purge control system which inhibits purging when the engine is driven in a driving region where a basic air-fuel ratio correction factor has not been learned, has been already proposed (refer the Unexamined Patent Publication (Kokai) No. 62-206262).

However, because driving regions change in accordance with the driving conditions, purging is frequently interrupted if basic air-fuel ratio correction factors are not learned in many regions. This is not only defeats the requirement that purging must be continued as much as possible, but also causes mistaken learning.

Furthermore, when a large amount of fuel-vapor is stored in the charcoal canister, it is unavoidable that the air-fuel ratio is disturbed by frequent interruptions in the purging.

SUMMARY OF THE INVENTION

It is an object of the present invention to provide an apparatus for disposing of fuel-vapor which can purge as often as possible, and can avoid mistaken learning of basic air-fuel ratio correction factors.

According to the present invention, the learning of the basic air-fuel ratio correction factor is not executed and the purging is executed when the basic air-fuel ratio correction factor has not been learned and a large amount of fuel is contained in the purge gas. On the other hand, the purging is stopped and the learning of the basic air-fuel ratio correction factor is executed when the concentration of the fuel in the purge gas fulls below a threshold concentration, that is, when the charcoal canister still has an ability to absorb the fuel-vapor.

BRIEF DESCRIPTION OF THE DRAWINGS

The present invention will be more clearly understood from the description, as set forth below, with reference to accompanying drawings, wherein.

DESCRIPTION OF THE PREFERRED EMBODIMENT

Figure 1:
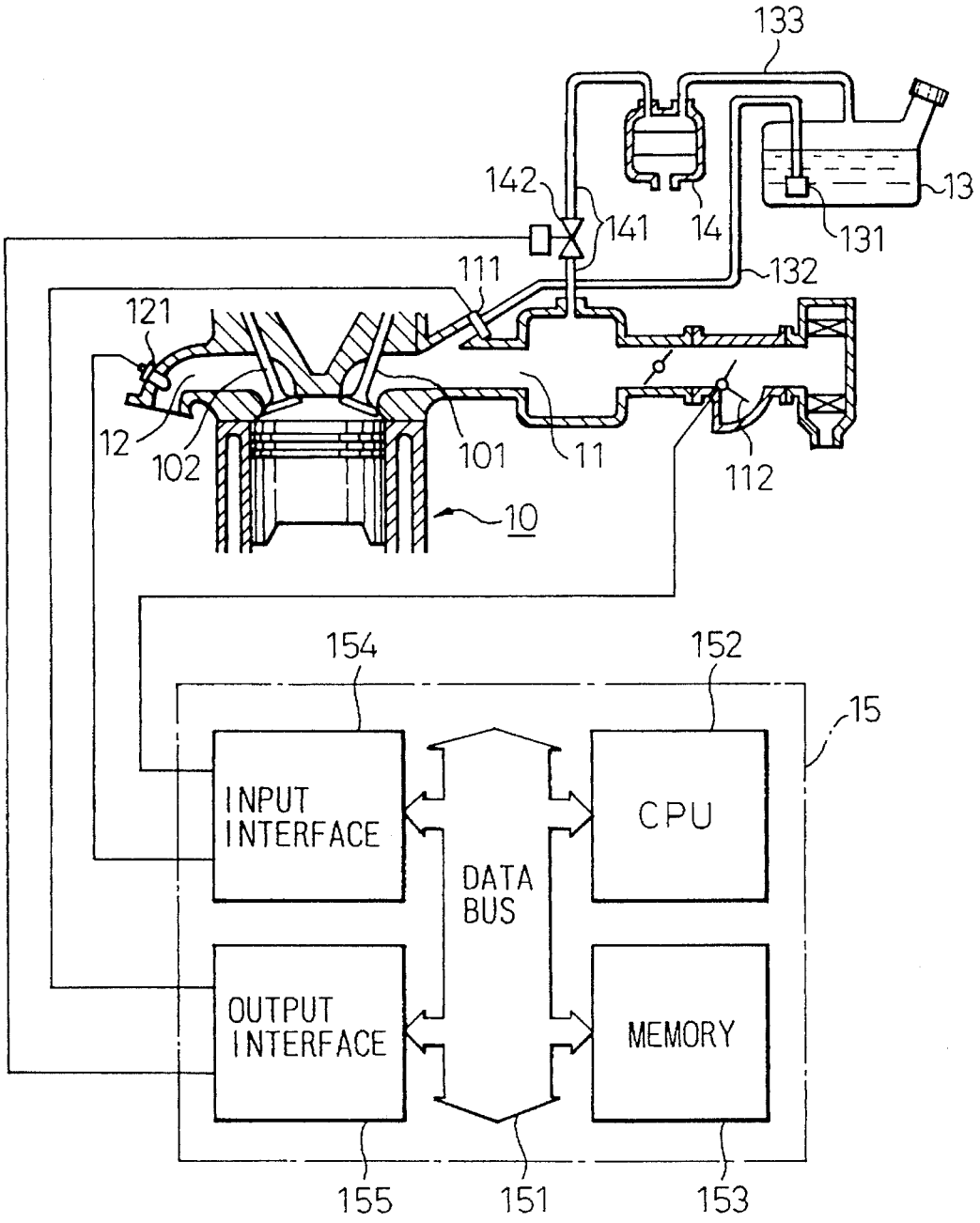
FIG. 1 is a schematic diagram of an apparatus for disposing of fuel-vapor according to the present invention.

FIG. 1 is a schematic diagram of the apparatus for disposing of fuel-vapor according to the present invention in which one cylinder 10 of the engine is connected to an inlet pipe 11 through an inlet valve 102 and to an exhaust pipe 12 through an exhaust valve 102.

The fuel injection valve 111 is arranged, adjacent to the inlet valve, on the inlet pipe 11.

Fuel stored in a fuel tank 13, and pressurized by a fuel pump 131 is supplied to the fuel injection valve 111 through a fuel pipe 132.

Fuel-vapor evaporating from the fuel tank 13 is led to a charcoal canister 14 through a vapor pipe 133.

The charcoal canister 14 is connected to the inlet pipe 11 by the purge pipe 141, and the purge valve 142 is installed on the purge pipe 141.

An air-fuel ratio sensor 121 which detects the air-fuel ratio of the exhaust gas is installed on the exhaust pipe 12.

The apparatus for disposing of fuel-vapor is controlled by the control system 15, and the control system is constructed as a microcomputer system.

That is, the control system 15 has a data-bus 151, a CPU 152, a memory 153, an input interface 154 and an output interface 155.

The air-fuel ratio sensor 121 is connected to the input interface 154, and the air-fuel ratio is detected by the control system.

The control system 15 controls the fuel injection valve 111 and the purge control valve 142 through the output interface 155.

According to the apparatus for disposing of fuel-vapor, the fuel-vapor evaporated from the fuel tank 13 is absorbed in the charcoal canister 14.

Because the pressure in the inlet pipe 11 is negative, fuel-vapor absorbed in the charcoal canister 14 is supplied to the inlet pipe 11 through the purge pipe 141 when the purge control valve 142 is opened, and is used as fuel when mixed with the fuel injected by the fuel injection valve 111.

On the other hand, the air-fuel ratio of the exhaust gas is detected by the air-fuel ratio sensor 121, and is used to determine the period during which the fuel injection valve 111 is opened by the control system 15.

Namely, as the purging of the fuel-vapor disturbs the air-fuel control, it is necessary to purge the fuel-vapor as often as possible while the exhaust gas is clean.

Figure 2:
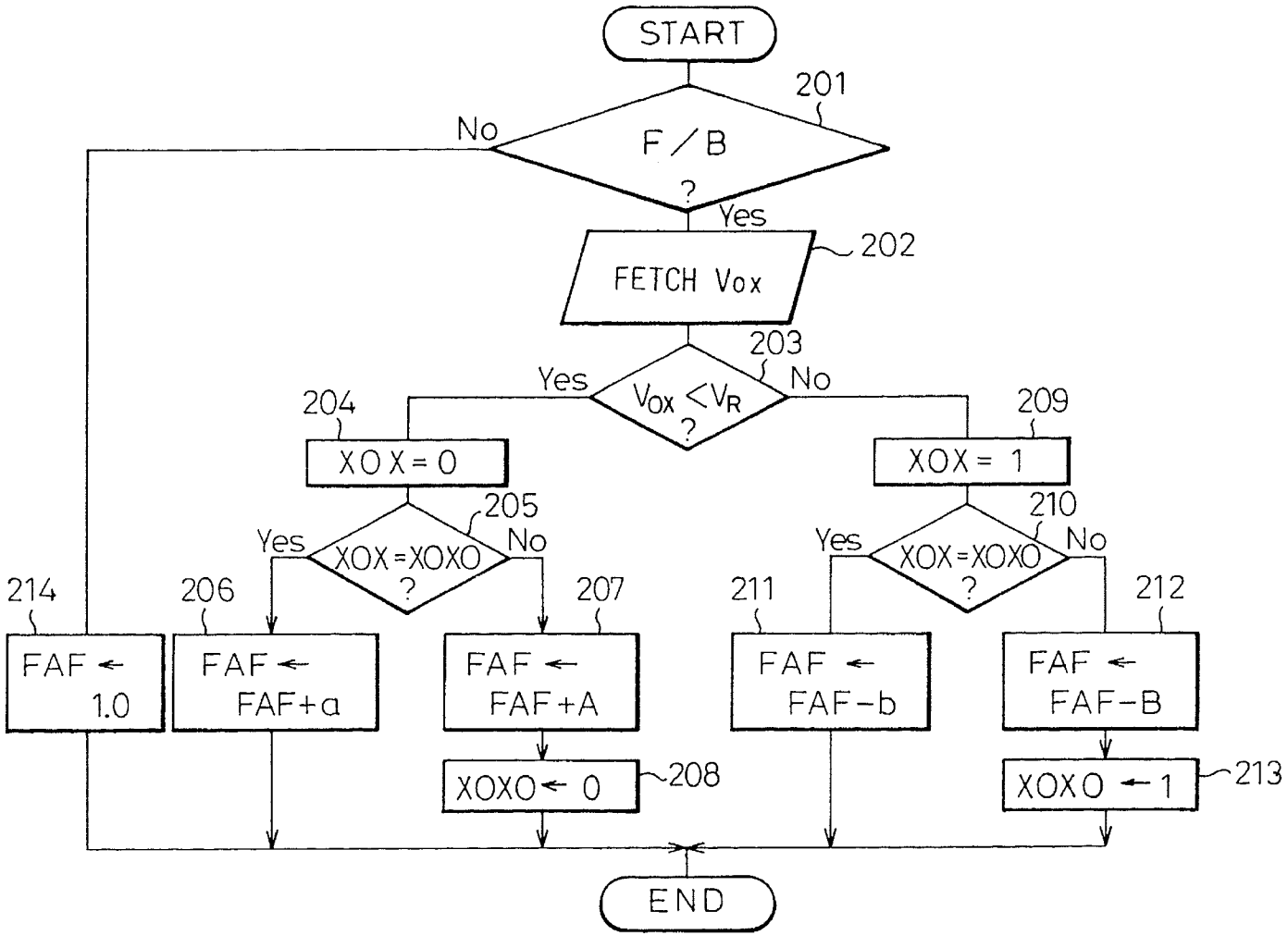
FIG. 2 is a flow-chart of the first air-fuel ratio control routine.

FIG. 2 is the flowchart of the air-fuel control routine executed in the apparatus for disposing of fuel-vapor according to the present invention, and this routine is executed at every predetermined cam angle.

At step 201, it is determined whether or not the air-fuel control is allowable.

Namely, (1) The engine is not being started.

(2) The fuel is not being cut.

(3) The coolant temperature (THW)≧40° C.

(4) The air-fuel ratio sensor has been activated.

When all above-mentioned conditions are satisfied, the air-fuel ratio feedback control is allowed. However, if any one of the above-mentioned conditions is not satisfied, it is not allowed.

If the determination at step 201 is affirmative, the control proceeds to step 202, where the output voltage $V_{ox}$ of the air-fuel ratio sensor 121 is fetched. At step 203, it is determined whether or not the output voltage $V_{ox}$ is lower than the predetermined reference voltage $V_R$ (for example, 0.45 V).

If the determination at step 203 is affirmative, that is, if the air-fuel ratio of the exhaust gas is lean, the control proceeds to step 204, where the air-fuel ratio flag XOX is set to "0".

At step 205, it is determined whether or not the air-fuel ratio flag XOX is identical with the status keeping flag XOXO.

If the determination at step 205 is affirmative, that is, if the lean state continues, the control proceeds to step 206, where the air-fuel ratio correction factor FAF increases the lean integration constant "a", and this routine is terminated.

If the determination at step 205 is negative, that is, if the air-fuel ratio changes from the rich state to the lean state, the control proceeds to step 207, where the air-fuel ratio correction coefficient FAF increases the lean skip constant "A".

Note, the lean skip constant "A" is set to a much larger value than the lean integration constant "a".

At step 208, the status keeping flag XOXO is reset, and this routine is terminated.

If the determination at step 203 is negative, that is, if the air-fuel ratio of the exhaust gas is rich, the control proceeds to 209, where the air-fuel ratio flag XOX is set to "1".

At step 210, it is determined whether or not the air-fuel ratio flag XOX is identical with the status keeping flag XOXO.

If the determination at step 210 is affirmative, that is, if the rich state continues, the control proceeds to step 211, where the air-fuel ratio correction factor FAF decreases the rich integration constant "b", and this routine is terminated.

If the determination at step 210 is negative, that is, the air-fuel ratio changes from the lean state to the rich state, the control proceeds to step 212, where the air-fuel ratio correction factor FAF decreases the rich skip constant "B".

Note, the rich skip constant "B" is set as much larger value than the rich integration constant "b".

At step 213, the status keeping flag XOXO is set to "1", and this routine is terminated.

Note, when the determination at step 201 is negative, the control proceeds to step 214, where the air-fuel ratio correction factor FAF is set to "1", and this routine is terminated.

Figure 3:
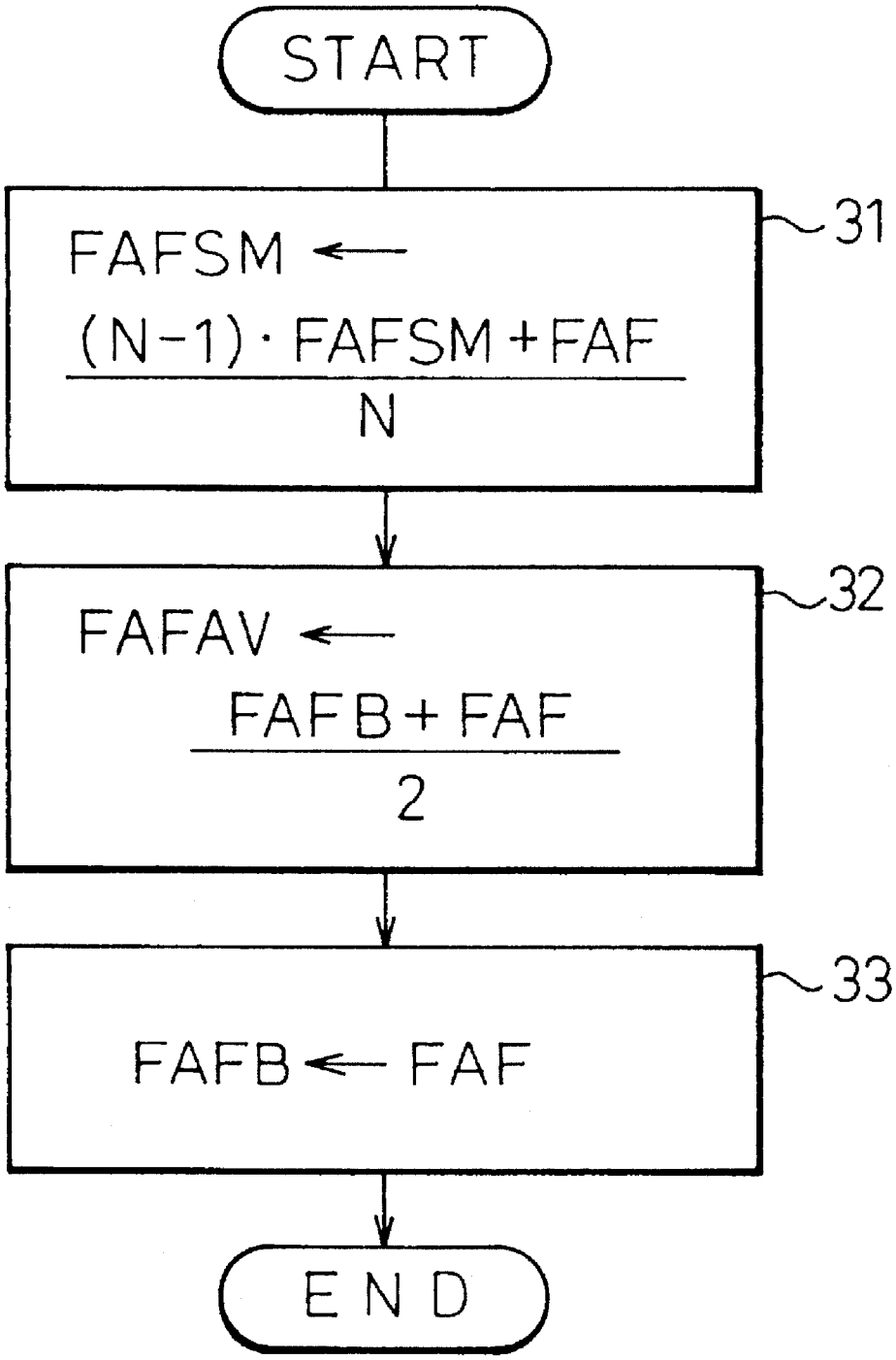
FIG. 3 is a flow-chart of a weighted moving average air-fuel ratio correction factor and an average air-fuel ratio correction factor calculating routine.

FIG. 3 is a flow-chart of a weighted moving average air-fuel ratio correction factor and an average air-fuel ratio correction factor calculating routine, which is executed after the air-fuel ratio control routine shown in FIG. 2.

At step 31, a weighted moving average air-fuel ratio FAFSM is calculated from the following equation.

$$FAFSM=\{(N-1)\cdot FAFSM+FAFS\}/N$$

Namely, the late weighted moving average air-fuel ratio correction factor FAFSM is calculated an average of the last weighted moving average air-fuel ratio correction factor FAFSM weighted by "N−1" and the late air-fuel ratio correction factor FAF weighted by "1". Note, N should be set to a comparatively large number, such as 100.

At step 32, the average air-fuel ratio correction factor FAFAV is calculated from the following equation.

$$FAFAV+(FAFB+FAF)/2$$

Where FAFB is the last average air-fuel ratio correction which is determined in the last execution.

At step 33, FAFB is set to FAF for the next execution.

Figure 4:
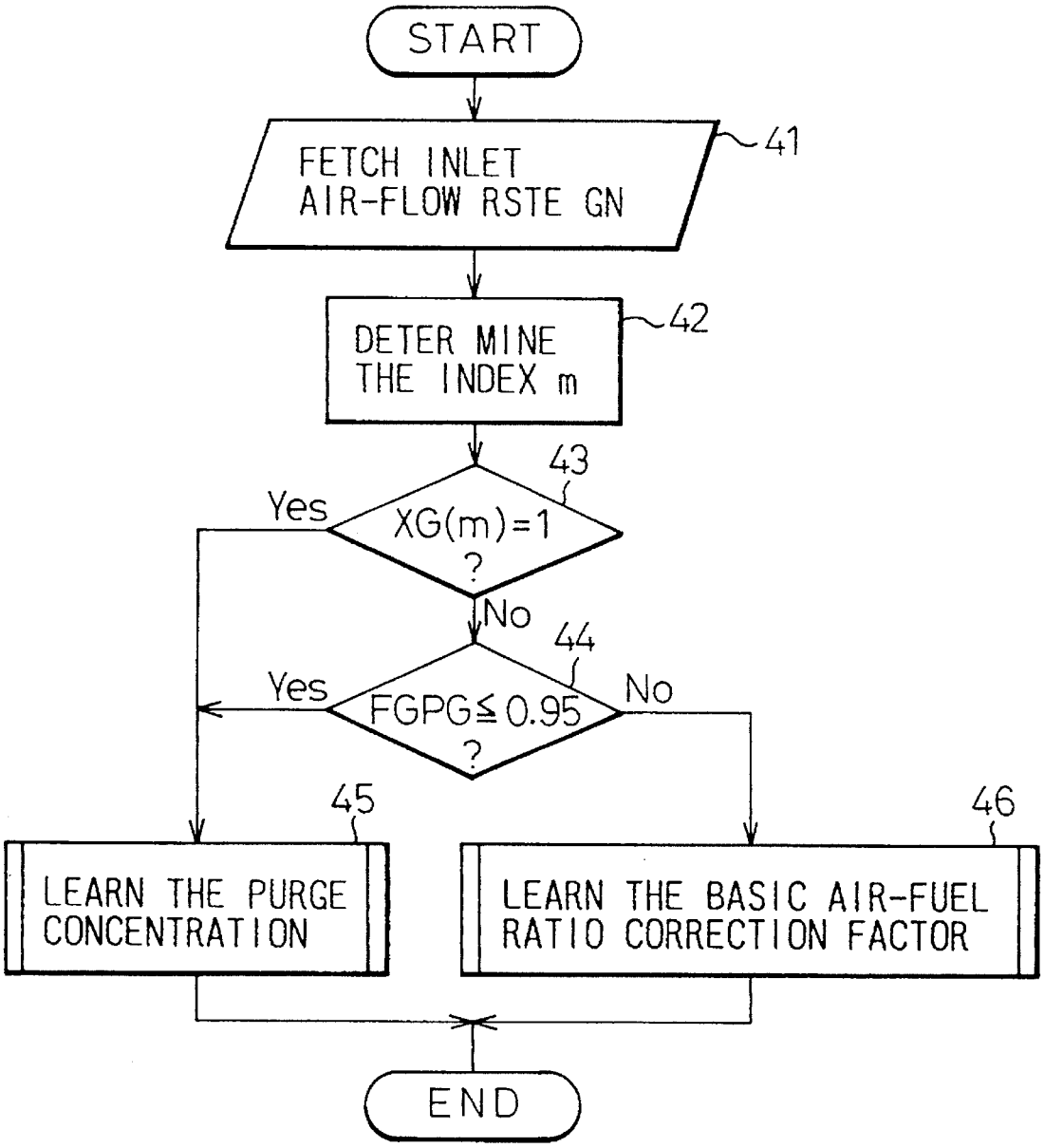
FIG. 4 is a flow-chart of a learning control routine.

FIG. 4 is the flowchart of the learning control routine, which controls switching between the learning of the purge concentration and the learning of the basic air-fuel ratio correction factor.

At step 41, the inlet air-flow rate GN detected by the air-flow meter 112 is fetched, and the index m which denotes an operating region of the engine is determined at step 42.

Namely, operating regions are determined by dividing the air-flow rate by M, and the index m is determined by judging to which region the present inlet air-flow rate GN belongs.

At step 43, it is determined whether or not the learning flag XG(m) is "1". Note, it is set to "1" when the learning of the basic air-fuel ratio correction factor is completed.

If the determination at step 43 is negative, the control proceeds to step 44, where it is determined whether or not a purge concentration index FGPG which is discussed later is less than a predetermined threshold (for example, 0.95), that is, whether or not the fuel amount contained in the purge gas is high.

If the determination at step 43 is affirmative, that is, if the learning of the basic air-fuel ratio correction factor is completed, the control proceeds to step 45 in order to learn the purge concentration.

Furthermore, if the determination at step 44 is affirmative, that is, if the fuel amount contained in the purge gas is high, the control proceeds to step 45, where the purge concentration learning routine is executed in order to avoid the mistaken learning of the basic air-fuel ratio correction factor and determine the purge concentration index in accordance with the last weighted moving average air fuel ratio correction factor.

If the determination at step 44 is negative, that is, if the basic air-fuel ratio correction factor has not been learned and the fuel amount in the purge gas is less, the control proceeds to step 46, where the basic air-fuel ratio correction factor learning routine is executed.

Figure 5:
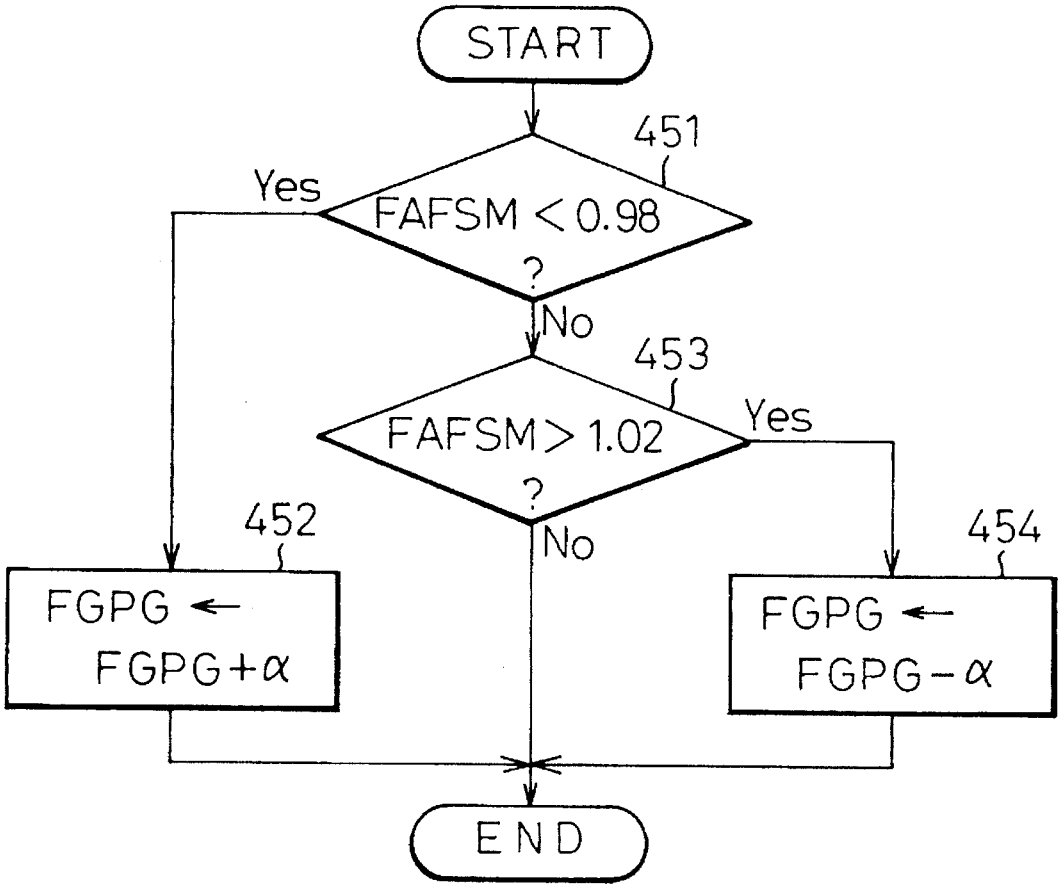
FIG. 5 is a flow-chart of the vapor concentration learning routine.

FIG. 5 is the flowchart of the purge concentration learning routine executed at step 45 which determines whether or not the moving weighted average FAFSM, that is, the long period average of FAF is less than the lower threshold (for example, 0.98).

If the determination at step 451 is affirmative, that is, if the moving weighted average FAFSM is lean, the control proceeds to step 452, where the purge concentration index FGPG increases the predetermined constant α, because the present purge concentration index FGPG becomes too large, that is, the fuel amount is too high.

If the determination at step 451 is negative, the control proceeds to step 453, where the moving weighted average FAFSM is larger than the upper threshold (for example, 1.02).

If the determination at step 451 is affirmative, the control proceeds to step 454, where the purge concentration index FGFPG decreases the predetermined constant α, and this routine is terminated.

On the other hand, if the determination at step 453 is negative, this routine is directly terminated.

Figure 6:
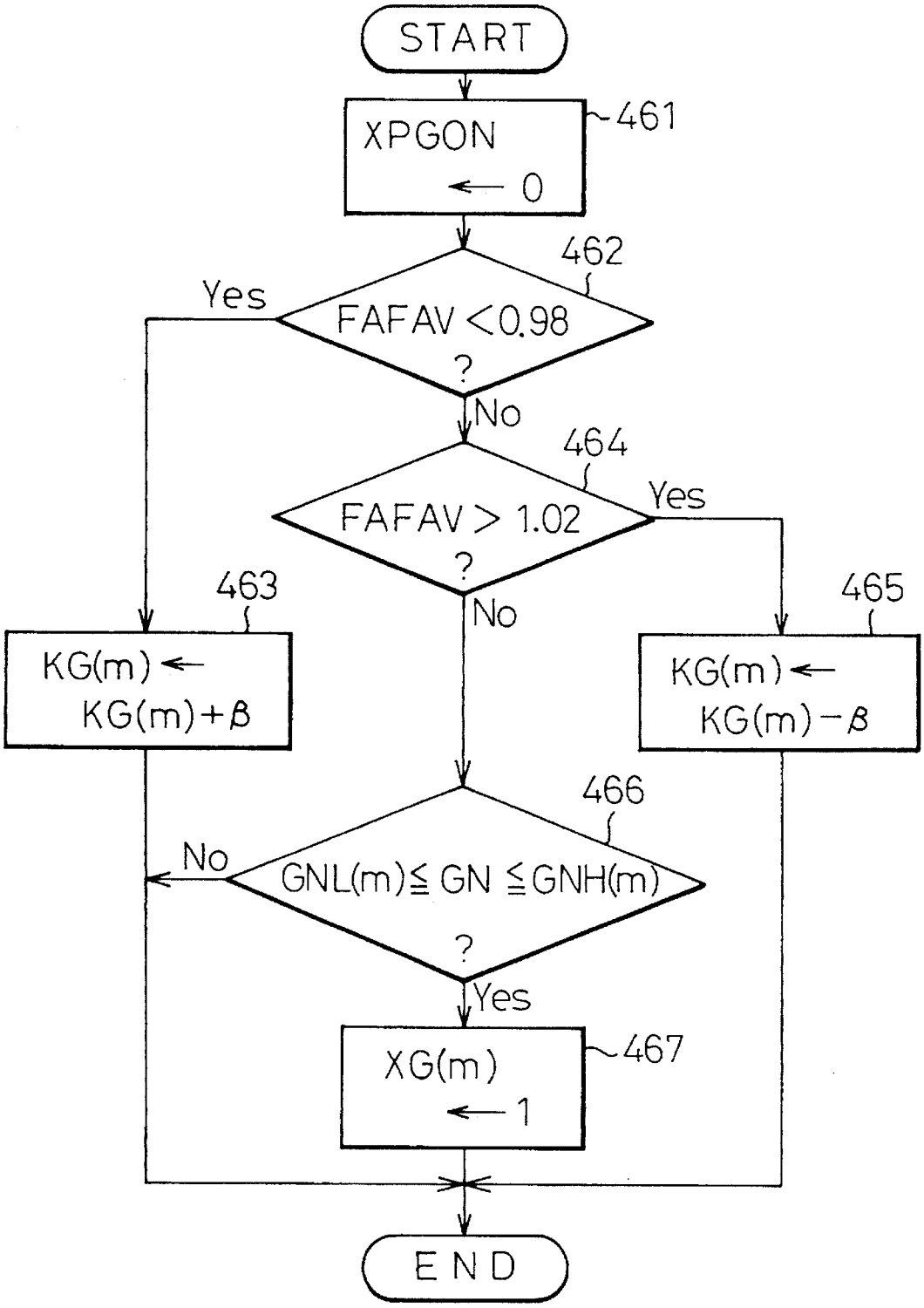
FIG. 6 is a flow-chart of the basic air-fuel ratio learning routine.

FIG. 6 is the flowchart of the basic air-fuel correction factor learning routine in which a purge executing flag XPGON is reset at step 461.

At step 462, it is determined whether or not the average FAFAV is less than the lower threshold.

If the determination at step 462 is affirmative, the control proceeds to step 463, where the basic air-fuel ratio correction factor KG(m), corresponding to the region m, increases the predetermined constant β, and this routine is terminated.

If the determination at step 462 is negative, the control proceeds to step 464 where it is determined whether or not the average FAFAV is larger than the upper threshold.

If the determination at step 462 is affirmative, the control proceeds to step 465, where the basic air-fuel ratio correction factor KG(m), corresponding to the region m, decreases the predetermined constant β, and this routine is terminated.

If the determination at step 464 is negative, that is, the basic air-fuel ratio correction factor KG(m) corresponding to the region m has already been determined as the correct value, the control proceeds to step 466.

At step 466, it is determined whether or not the present inlet air flow is between GNL(m) and GNH(m). Note, GNL(m) denotes the minimum inlet-air flow in the region m required in order to allow learning, and GNH(m) denotes the maximum inlet-air flow in the region m required in order to allow learning.

If the determination at step 466 is negative, that is, if the basic air-fuel ratio correction factor has not been leaned, this routine is directly terminated.

If the determination at step 466 is affirmative, that is, if the basic air-fuel ratio correction factor KG(m) has been learned, the control proceeds to step 467, where the learning flag XG(m) corresponding to the region m is set to "1", and this routine is terminated.

Figure 7:
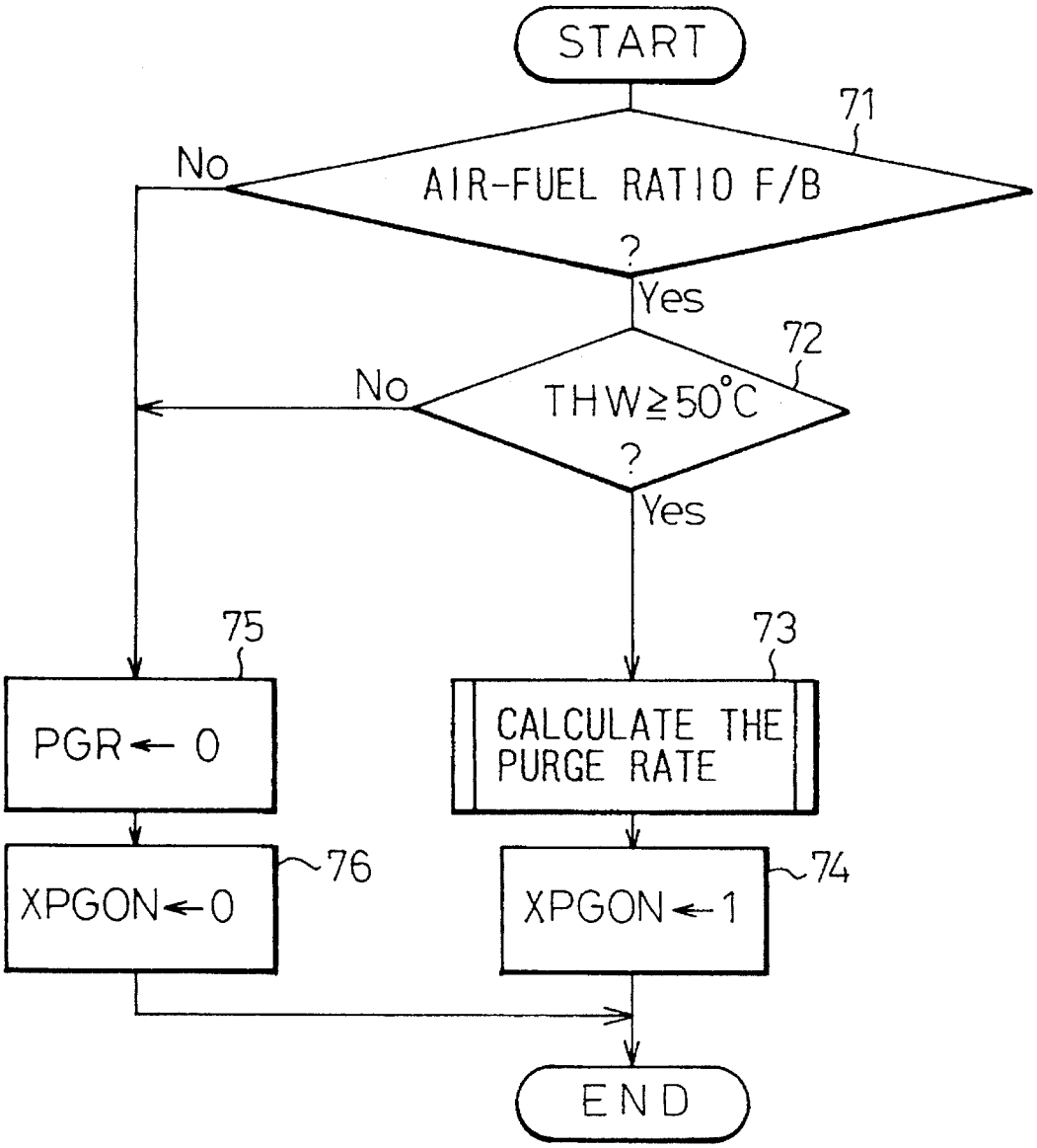
FIG. 7 is a flow-chart of the purge rate control routine.

FIG. 7 is the flowchart of the purge rate control routine, it is determined whether or not the air-fuel ratio feedback control is allowed.

If the determination at step 71 is affirmative, the control proceeds to step 72, where it is determined whether or not the coolant temperature THW is more than 50° C.

if the determination at step 72 is affirmative, the control proceeds to step 73, where the purge rate calculating routine is executed, and this routine is terminated after the purge executing flat XPGON is set to "1" at step 74.

If the determination at step 71 or step 72 is negative, the control proceeds to step 75, where the purge rate PGR is reset, and this routine is terminated after the purge executing flag XPGON is reset at step 76.

Figure 8:
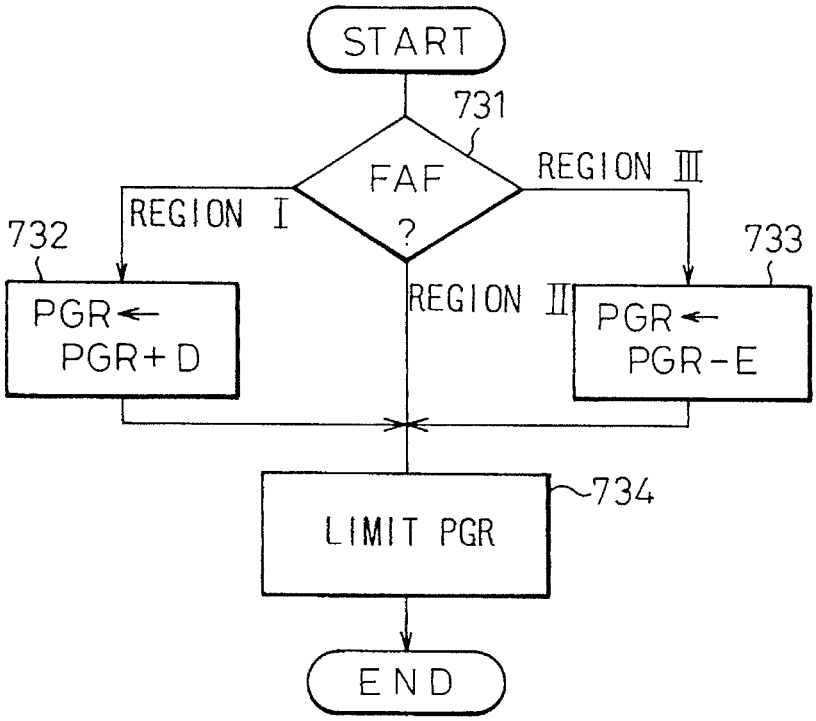
FIG. 8 is a flow-chart of the purge rate calculating routine.

FIG. 8 is the flowchart of the purge rate calculating routine executed at step 73, and it is determined to which region the air-fuel ratio correction factor belongs at step 731.

Figure 9:
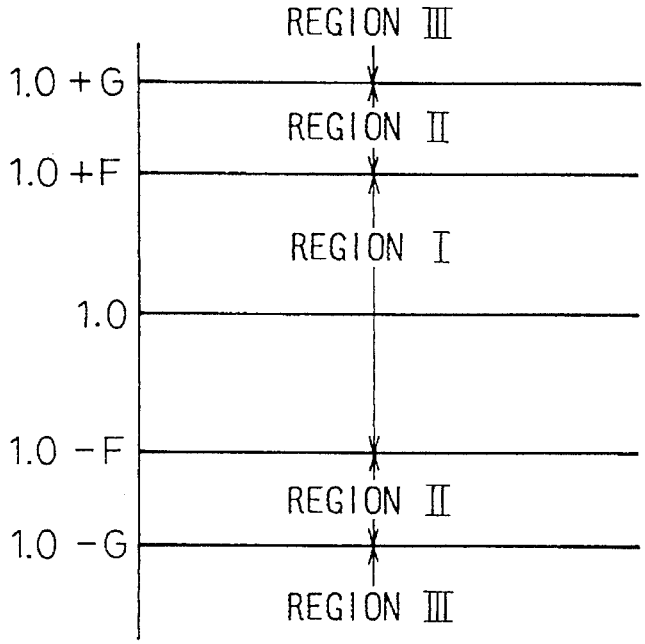
FIG. 9 is a graph for showing the domain of the air-fuel ratio correction factor; and, FIG. 10 is a flow-chart of the purge valve driving routine.

FIG. 9 is the graph showing the regions of the air-fuel ratio correction factor, and it is determined that is belongs to the region "I" if it is within 1±F, that it belongs to the region "II" if it is between 1±F and 1±G, and that it belongs to the region "III" if it is outside 1±G. Note, 0<F<G.

If the determination at 731 is that the air-fuel ratio correction factor belongs to the region "I", the control proceeds to step 732, where the purge rate PGR is increased by the purge increasing amount D, and the control proceeds to step 734.

If the determination at 731 is that the air-fuel ratio correction factor belongs to the region "II", the control directly proceeds to step 734.

If the determination at 731 is that the air-fuel ratio belongs to the region "III", the control proceeds to step 733, where the purge rate PGR decreases by the purge decreasing amount E, and the control proceeds to step 734.

At step 734, the purge rate PGR is limited by the lower limit and the upper limit, and this routine is terminated.

Figure 10:
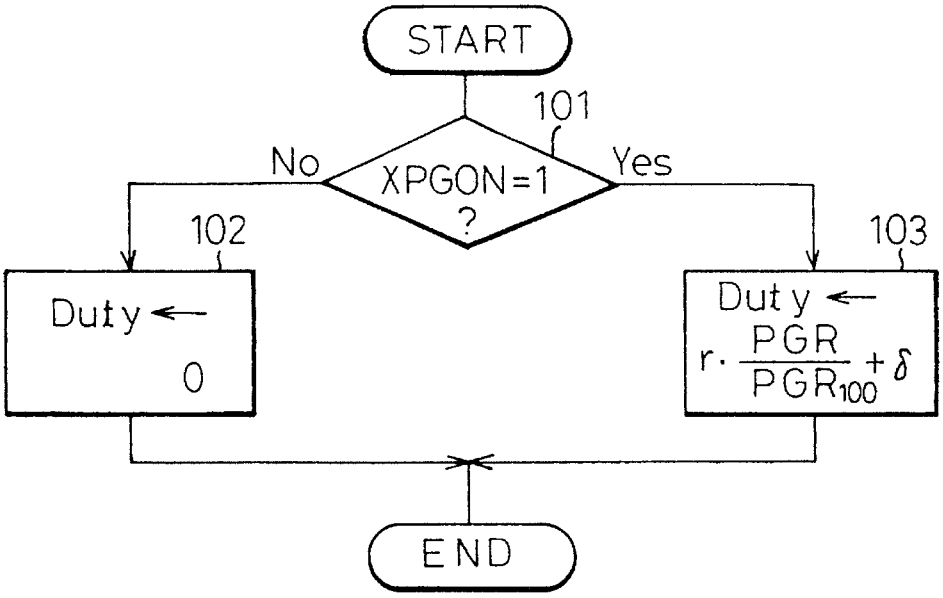

FIG. 10 is the flowchart of the purge control valve driving routine, and it is determined whether or not the purge executing flag XPGON is "1" at step 101. If the determination is negative, this routine finishes after the duty ratio Duty is set to "0" at step 102.

If the determination-at step 101 is affirmative, the control proceeds to step 103, where the duty ratio Duty is calculated from the following equation.

$$Duty=\gamma\cdot PGR/PGR_{100}+\delta$$

Where $PGR_{100}$ is the purge rate at the full opening of the purge control valve, and it is previously determined as a function of the engine speed Ne and the engine load (for example the inlet-air amount GN).

γ and δ are the correction coefficients according to the battery voltage and the atmospheric pressure respectively.

Figure 11:
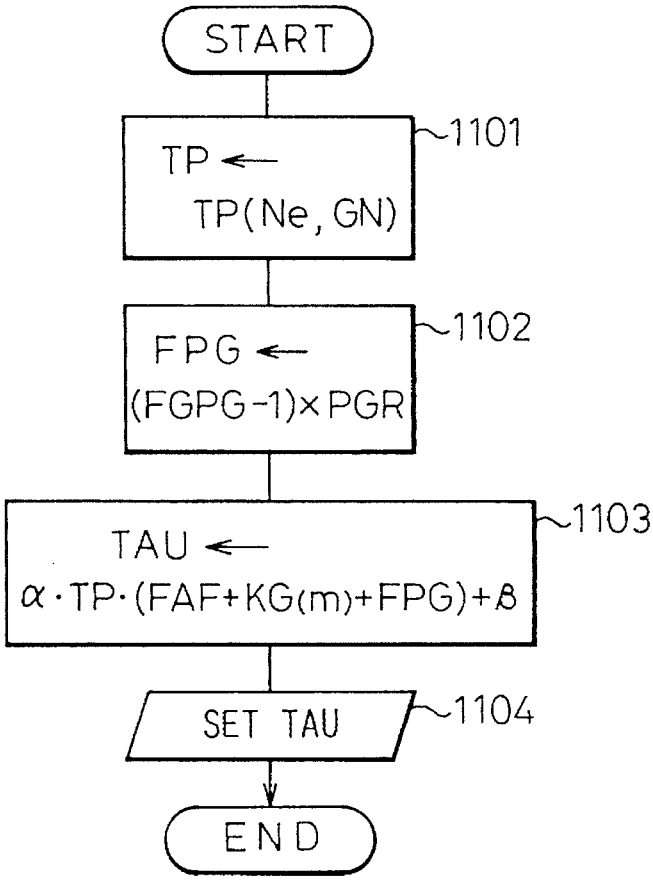
FIG. 11 is a flow-chart of the fuel injection valve control routine.

FIG. 11 is the flowchart of the fuel injection valve control routine executed at every predetermined crank angle.

At step 1101, the basic fuel injection valve opening interval Tp is calculated as a function of the engine speed Ne and the inlet-air rate GN.

$$Tp=Tp(Ne, GN)$$

At step 1102, the purge correction factor FPG is calculated based on the vapor concentration index FGPG calculated in the vapor concentration learning routine shown in FIG. 5 and the purge rate PGR calculated in the purge rate control shown in FIG. 7.

$$FPG=(FGPG-1)\cdot PGR$$

At step 1103, the fuel injection valve opening interval TAU is calculated based on the air-fuel ratio correction factor FAF calculated in the air-fuel ratio control routine shown in FIG. 2 and the base air-fuel ratio correction factor KG(m) and the purge correction coefficient FPG which are calculated in the base air-fuel ratio correction factor learning routine according to the following equation.

$$TAU=\alpha\cdot Tp\cdot\{FAF+KG(m)+FPG\}+\beta$$

Where, α and β are the correction coefficients based on the starting fuel increasing amount and the warmed-up fuel increasing amount, etc.

At step 1104, the fuel injection valve opening interval TAU is output, and this routine is terminated.

By using the apparatus for disposing of fuel-vapor according to the present invention, it becomes possible not only to decrease the fuel amount stored in the charcoal canister, but also to avoid the faulty learning of the basic air-fuel ratio correction factor by purging without learning the basic air-fuel ratio correction factor when it has not been learned and a large amount of fuel is contained in the purge gas.

Furthermore, it is also possible to learn correctly the basic air-fuel ratio correction factor by learning it after the purge is stopped and the fuel stored in the charcoal canister is sufficiently purged.

I claim:

1. An apparatus for disposing of fuel-vapor comprising:

a charcoal canister for absorbing the fuel-vapor evaporating from a fuel tank of an engine;

a purge valve arranged in a purge pipe which connects said charcoal canister and an inlet pipe, and controls the flow rate of the purge gas;

an air-fuel ratio detecting means arranged in an exhaust pipe of the engine for detecting the air-fuel ratio of the exhaust gas;

an air-fuel ratio control means for calculating an air-fuel ratio correction factor in order to control the air-fuel ratio detected by said air-fuel ratio detecting means to a predetermined target air-fuel ratio;

a vapor concentration learning means for learning the vapor concentration of the fuel-vapor purged into the inlet pipe in accordance with the air-fuel ratio correction factor calculated by said air-fuel ratio control means;

a basic air-fuel ratio correction factor learning means for learning the base air-fuel ratio correction factor in accordance with the air-fuel ratio correction factor calculated by said air-fuel ratio control means; and a purge valve control means for controlling the opening of the purge valve in accordance with the air-fuel ratio correction factor calculated by said air-fuel ratio control means, the vapor concentration learned by said vapor concentration learning means and the basic air-fuel ratio correction factor learned by said basic air-fuel ratio correction factor learning means; wherein said apparatus for disposing of fuel-vapor further includes a learning control means, which opens said purge valve, allows the learning of the concentration of the fuel-vapor by said vapor concentration learning means, and inhibits the learning of the basic air-fuel correction factor by said basic air-fuel correction factor learning means when it is determined that the basic air-fuel correction factor has been learned by said basic air-fuel correction factor learning means, or when it is determined that the basic air-fuel correction factor has not been learned by said basic air-fuel correction factor learning means and the concentration of fuel-vapor in the purged gas is high, and which closes said purge valve, inhibits the learning of the concentration of the fuel-vapor by said vapor concentration learning means, and allows the learning of the basic air-fuel correction factor by said basic air-fuel correction factor learning means when it is determined that the basic air-fuel correction factor has not been learned by said basic air-fuel correction factor learning means and the concentration of fuel-vapor in the purge-gas is low.

2. A method of disposing of fuel-vapor comprising the steps of:

calculating an air-fuel ratio correction factor and a fuel injection valve opening interval in order to control the air-fuel ratio detected by an air-fuel ratio detecting sensor to a predetermined target air-fuel ratio;

learning the concentration of the fuel-vapor purged into the inlet pipe in accordance with the air-fuel ratio correction factor calculated by said air-fuel ratio calculating step;

learning the basic air-fuel ratio correction factor in accordance with the air-fuel ratio correction factor calculated by said air-fuel ratio calculating step; and controlling the opening of the purge valve in accordance with the air-fuel ratio correction factor calculated at said air-fuel ratio control step, the vapor concentration learned at said vapor concentration learning step and the basic air-fuel ratio correction factor learned at said basic air-fuel ratio correction factor learning step; wherein said method of disposing of fuel-vapor further includes a learning control step, which opens a purge valve, allows the learning of the concentration of the fuel-vapor at said vapor concentration learning step, and inhibits the learning of the basic air-fuel correction factor at said basic air-fuel correction factor learning step when it is determined that the basic air-fuel correction factor has been learned at said basic air-fuel correction factor learning step, or when it is determined that the basic air-fuel correction factor has not been learned at said basic air-fuel correction factor learning step and the concentration of fuel-vapor in the purge-gas is high, and which closes said purge valve, inhibits the learning of the concentration of the fuel-vapor at said vapor concentration learning step, and allows the learning of the basic air-fuel correction factor at said basic air-fuel correction factor learning step when it is determined that the basic air-fuel correction factor has not been learned at said basic air-fuel correction factor learning means and the concentration of fuel-vapor in the purge-gas is low.

* * * * *